US009352441B2

(12) United States Patent
Zuniga et al.

(10) Patent No.: US 9,352,441 B2
(45) Date of Patent: May 31, 2016

(54) CHEMICAL MECHANICAL POLISHER WITH HUB ARMS MOUNTED

(71) Applicant: Applied Materials, Inc., Santa Clara, CA (US)

(72) Inventors: Steven M. Zuniga, Soquel, CA (US); Chih Hung Chen, Sunnyvale, CA (US); Jay Gurusamy, Santa Clara, CA (US)

( * ) Notice: Subject to any disclaimer, the term of this patent is extended or adjusted under 35 U.S.C. 154(b) by 0 days.

(21) Appl. No.: 14/510,195

(22) Filed: Oct. 9, 2014

(65) Prior Publication Data

US 2015/0105005 A1 Apr. 16, 2015

Related U.S. Application Data

(60) Provisional application No. 61/891,833, filed on Oct. 16, 2013.

(51) Int. Cl.
*B24B 37/10* (2012.01)
*B24B 37/34* (2012.01)

(52) U.S. Cl.
CPC ..... *B24B 37/10* (2013.01); *B24B 37/345* (2013.01)

(58) Field of Classification Search
CPC ..... B24B 37/10; B24B 37/345; B24B 51/00; B24B 41/06; B24B 3/343; B23Q 16/06; B23Q 16/065; B23F 23/08
USPC ..... 451/259, 64–66, 342, 403
See application file for complete search history.

(56) References Cited

U.S. PATENT DOCUMENTS 2,389,668 A * 11/1945 Johnson ..... B23Q 16/065 269/57
3,715,841 A * 2/1973 Schnellman ..... B24B 3/343 451/22
4,872,289 A * 10/1989 Yukawa ..... B23Q 7/043 451/10
5,584,647 A * 12/1996 Uehara ..... B25J 9/042 414/226.01
6,139,405 A * 10/2000 Becker ..... B24B 41/06 451/268
6,155,768 A * 12/2000 Bacchi ..... H01L 21/67742 414/416.03
6,358,128 B1 * 3/2002 Sakurai ..... B24B 37/042 257/E21.23
6,547,510 B1 * 4/2003 Beaulieu ..... B23H 9/06 414/744.5
6,916,231 B2 * 7/2005 Wakabayashi ..... B08B 1/04 451/282

(Continued)

*Primary Examiner* — George Nguyen
(74) *Attorney, Agent, or Firm* — Patterson & Sheridan, LLP

(57) ABSTRACT

A chemical mechanical polishing system is provided. The chemical mechanical polishing system includes a platen, a load cup, a hub, a first polishing arm cantilevered from the hub and rotatable around the centerline of the hub between the platen and load cup, and a second polishing arm cantilevered from the hub and rotatable around the centerline of the hub between the platen and load cup the second arm rotatable independently from the hub.

20 Claims, 6 Drawing Sheets

(56) References Cited

U.S. PATENT DOCUMENTS 7,037,174 B2 * 5/2006 Chen ..... B24B 37/042 257/E21.304
7,238,087 B1 * 7/2007 Kashiwa ..... B24B 7/228 451/287
8,078,304 B2 * 12/2011 Rice ..... G05B 19/41875 414/222.08
8,308,529 B2 * 11/2012 D'Ambra ..... B24B 27/0076 451/287
8,506,358 B2 * 8/2013 Amarell ..... B23F 23/04 409/9
2001/0041650 A1 * 11/2001 Senga ..... B24B 37/20 483/1
2001/0044266 A1 * 11/2001 Katsuoka ..... B24B 37/345 451/66
2004/0014407 A1 * 1/2004 Saitoh ..... B24B 41/06 451/262
2005/0191942 A1 * 9/2005 Chen ..... B24B 21/04 451/5
2005/0208876 A1 * 9/2005 Chen ..... B24B 49/00 451/5
2005/0239384 A1 * 10/2005 Eggart ..... B24B 41/066 451/364
2006/0035563 A1 * 2/2006 Kalenian ..... B24B 37/30 451/5
2007/0060024 A1 * 3/2007 Shirasu ..... B24B 37/30 451/41
2015/0105005 A1 * 4/2015 Zuniga ..... B24B 37/10 451/259

* cited by examiner

CHEMICAL MECHANICAL POLISHER WITH HUB ARMS MOUNTED

CROSS-REFERENCE TO RELATED APPLICATIONS

This application claims benefit of U.S. Provisional Application Ser. No. 61/891,833, filed Oct. 16, 2012, of which is incorporated by reference in its entirety.

BACKGROUND

1. Field of the Invention

Embodiments of the present invention generally relate to a method and apparatus for handling semiconductor substrates in a chemical mechanical polishing system.

2. Description of the Related Art

In the process of fabricating modern semiconductor integrated circuits (ICS), it is necessary to develop various material layers over previously formed layers and structures. However, the prior formations often leave the top surface topography unsuitable for the position of subsequent layers of material. For example, when printing a photolithographic pattern having small geometries over previously formed layers, a shallow depth of focus is required. Accordingly, it becomes essential to have a flat and planar surface, otherwise, some of the pattern will be in focus while other parts of the pattern will not. In addition, if the irregularities are not leveled prior to certain processing steps, the surface topography of the substrate can become even more irregular, causing further problems as the layers stack up during further processing. Depending on the die type and the size of geometries involved, the surface irregularities can lead to poor yield and device performance. Consequently, it is desirable to achieve some type of planarization, or polishing, of films during IC fabrication.

One method for planarizing a layer during IC fabrication is chemical mechanical polishing (CMP). In general, CMP involves pressing of the substrate against a polishing material while proving relative motion therebetween in presence of a polishing fluid. The polishing fluid that typically contains at least one of an abrasive or chemical polishing composition that assists in the planarization process. The substrate may progress through several different polishing materials of finer abrasive materials and/or chemistries to achieve a highly planarized or polished surface. Once polished, the semiconductor substrate is transferred from the CMP to a series of cleaning modules that remove the abrasive particles and/or other contaminants that cling to the substrate after polishing.

As customer application needs have become more diverse and complex, a desire to provide a configurable and flexible CMP system has become paramount. Conventional CMP systems generally require all polishing heads to move between a polishing platen and a load cup or to other process/metrology stations in unison, thus making throughput dependent on the completion of the longest process being performed in the system. In addition, it is desirable that the CMP system be configured to minimize defect issues (real and perceived) from particles generated by the motion of the components of the system.

Therefore, there is a need in the art for an improved method and apparatus for handling semiconductor substrates in a CMP system.

SUMMARY

In a first embodiment, a chemical mechanical polishing system is provided. The chemical mechanical polishing system includes a platen, a load cup, a hub, a first polishing arm cantilevered from the hub and rotatable around the centerline of the hub between the platen and load cup, and a second polishing arm cantilevered from the hub and rotatable around the centerline of the hub between the platen and load cup the second arm rotatable independently from the hub.

In a second embodiment, a chemical mechanical polishing system is provided. The chemical mechanical polishing system includes a platen, a load cup, a hub rotatable about a first axis, a first polishing arm pivotally attached to a first pivot on the hub and moveable between the platen and load cup, and a second polishing arm pivotally attached to a second pivot on the hub and moveable between the platen and load cup.

In yet another embodiment, a method for moving a substrate by a substrate handler is provided. The method includes loading a substrate from a load cup into a first polishing head attached to a first end of a first polishing arm, wherein a second end of the first polishing arm is pivotally attached to a first pivot on an indexable hub, and moving the substrate to a processing station by either indexing the hub or rotating the first polishing arm about the pivot.

BRIEF DESCRIPTION OF THE DRAWINGS

So that the manner in which the above recited embodiments of the invention are obtained and can be understood in detail, a more particular description of the invention, briefly summarized above, may be had by reference to the embodiments thereof, which are illustrated in the appended drawings. It is to be noted, however, that the appended drawings illustrate only typical embodiments of the invention, and are therefore not to be considered limiting of its scope, for the invention may admit to other equally effective embodiments.

To facilitate understanding, identical reference numerals have been used, wherever possible, to designate identical elements that are common to the Figures. Additionally, elements of one embodiment may be advantageously adapted for utilization in other embodiments described herein.

DETAILED DESCRIPTION

Embodiments for a method and apparatus for handling substrates through a chemical mechanical planarizing (CMP) system are provided. The substrate handler includes a central hub with independently moveable polishing arms, each arm supporting a polishing head. Although the system is illustratively described having at least two processing stations suitable for planarizing a substrate disposed around a central substrate handler, it is contemplated that the system may be arranged in other configurations with more than two processing stations and optionally, more than two substrate handlers. Furthermore, the embodiments disclosed below focus primarily on removing material from, e.g., planarizing or polishing, a substrate, it is contemplated that the teachings disclosed herein may be used in other processing systems, for example, electroplating systems, and edge bevel removal systems, where efficient transfer of substrates is desired.

In one embodiment, the hub may rotate, or index, and the polishing arms are pivotally attached to an outer portion of the hub wherein a pivot for the polishing arms is incongruent with the rotational axis of the hub. This provides each polishing arm with the ability to rotate and move a substrate between different modules of the CMP system independent of the movement of the hub or other polishing arms and substrates. Thus, the substrate handler provides independent motion for each polishing head and independent movement for a substrate from a platen to a load cup or other process/metrology station.

In a second embodiment, the rotational axes for all the polishing arms may be coaxial with the center of a rotating or non-rotating hub. Each polishing head may move about a perimeter of the hub to independently position the other polishing heads coupled to the hub. Thus, the substrate may be moved to an available and accessible platen or load cup location independently of the other substrates being held by the substrate handler.

The drive gear assembly for moving the polishing arms of the substrate handler is advantageously inward of the platen. Therefore, any particulars or other contamination generated by the drive gear assembly cannot fall onto the platen and affect substrate polishing operations.

Figure 1:
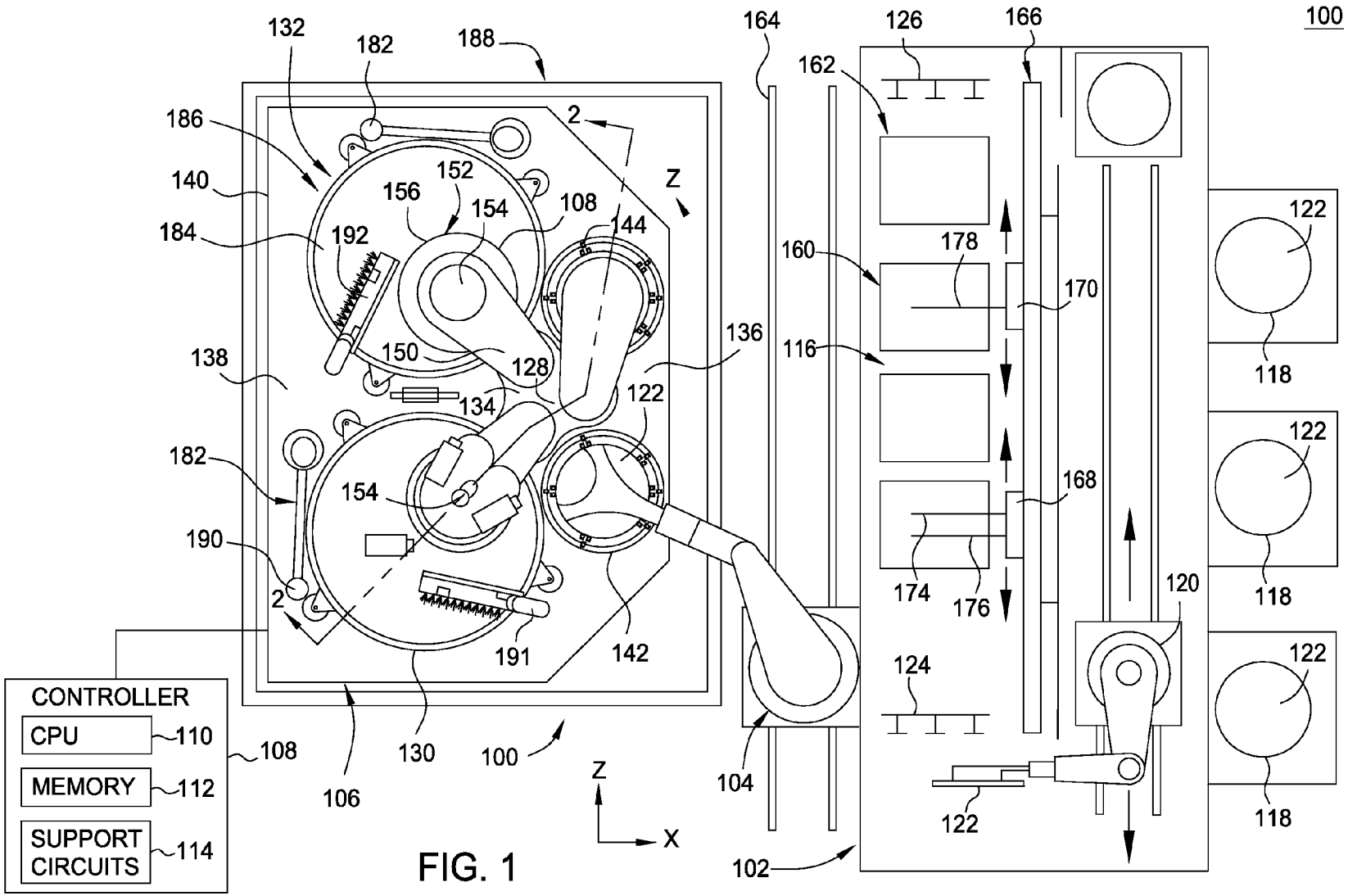
FIG. 1 is a top view of a chemical mechanical polishing (CMP) system having a polishing module.

FIG. 1 is a plan view of a CMP system 100 which provides independent motion of each polishing head, according to an embodiment. The exemplary system 100 generally comprises a factory interface 102, a loading robot 104, and a polishing module 106 coupled to a machine base 140. The loading robot 104 is disposed on a set of rails 164 proximate the factory interface 102 and the polishing module 106 to facilitate the transfer of substrates 122 therebetween.

A controller 108 is provided to facilitate control and integration of the modules of the CMP system 100. The controller 108 comprises a central processing unit (CPU) 110, a memory 112 and support circuits 114. The controller 108 is coupled to the various components of the CMP system 100 to facilitate control of, for example, the planarizing, cleaning and transfer processes.

The factory interface 102 generally includes a cleaner 116 and one or more wafer cassettes 118. An interface robot 120 is employed to transfer substrates 122 between the wafer cassettes 118, the cleaner 116 and an input module 124. The input module 124 is positioned to facilitate transfer of substrates 122 between the polishing module 106 and the factory interface 102 by grippers, for example, vacuum grippers or mechanical clamps.

The cleaner 116 removes polishing debris and/or polishing fluid that remains after polishing from the substrates. The cleaner 116 includes a handler 166 that moves substrates from the input module 124 through a plurality of cleaning modules 160 to a dryer 162. In one embodiment, the cleaning modules 160 include brush boxes and megasonic cleaners.

The substrate handler 166 generally includes a first robot 168 and a second robot 170. The first robot 168 includes at least one gripper (two grippers 174, 176 are shown) and is configured to transfer the substrate between at least the input module 124 and the cleaning modules 160. The second robot 170 includes at least one gripper (a gripper 178 is shown) and is configured to transfer the substrate between at least the one of the cleaning modules 160 and the dryer 162.

In operation, the CMP system 100 is initiated with the unpolished substrate 122 being transferred from one of the cassettes 118 to the input module 124 by the interface robot 120. The loading robot 104 then removes the substrate from the input module 124 and transfers the substrate 122 to the polishing module 106, where the substrate 122 is polished while in a horizontal orientation. Once the substrate 122 is polished, the loading robot 104 extracts the substrate 122 from the polishing module 106 and places the polished substrate 122 in the input module 124 in a vertical orientation. The substrate handler 166 retrieves the polished substrate 122 from the input module 124 and moves the substrate through at least one of the cleaning modules 160 of the cleaner 116. Each of the cleaning modules 160 is adapted to support a substrate in a vertical orientation throughout the cleaning process. Once cleaned, the handler 166 transfers the substrate to an output module 126, where the cleaned substrate 122 is flipped to a horizontal orientation and returned by the interface robot 120 to one of the cassettes 118.

The polishing module 106 includes at least one chemical mechanical planarizing (CMP) or other suitable planarizing station. In one embodiment, the polishing module 106 includes one or more chemical mechanical planarizing (CMP) station 130, 132 disposed in an environmentally controlled enclosure 188. Examples of polishing module 106 that can be adapted to benefit from the invention include MIRRA®, MIRRA MESA™, REFLEXION®, REFLEXION® LK, and REFLEXION LK Ecmp™ Chemical Mechanical Planarizing Systems, all available from Applied Materials, Inc. of Santa Clara, Calif. Other planarizing modules, including those that use processing pads, planarizing webs, or a combination thereof, and those that move a substrate relative to a planarizing surface in a rotational, linear or other planar motion may also be adapted to benefit from the invention.

The CMP stations 130, 132 include a platen 186 that supports a removable polishing pad 184. The platen 186 rotates the pad 184 while a slurry nozzle 192 provides a polishing fluid to the top surface of the pad 184 used for polishing the substrate 122. A conditioner assembly 182 is disposed on the base 140 adjacent each of the CMP stations 130, 132. The conditioner assembly 182 includes a conditioning head 190 for periodically conditioning the pad 184 disposed in the CMP stations 130, 132 for the purpose of maintaining uniform planarizing results.

The exemplary polishing module 106 also includes a transfer station 136 and a substrate handler 128 that are disposed on an upper side 138 of a machine base 140. In one embodiment, the transfer station 136 includes two load cups 142, 144. The input buffer at load cup 142 receives unpolished substrates 122 from the factory interface 102 by the loading robot 104. The loading robot 104 is also utilized to return polished substrates from the load cup 144 to the factory interface 102. It is also contemplated that the load cup 142 may be used to transfer polished substrates while load cup 144 may be used to transfer unpolished substrates. It is further contemplated that each of the load cups 142, 144 may be used to transfer both polished and unpolished substrates.

The substrate handler 128 may include a central rotating mechanism (hub 134) and a plurality of polishing arms 150 extending cantilevered from the hub 134. In one embodiment, the plurality of polishing arms 150 are pivotally attached to the hub 134 at a first end and each polishing arm 150 supports a polishing head assembly 152 at a second end. The polishing head assembly 152 may include a motor/actuator 154 and a polishing head 156. It should be understood that the polishing head assembly 152, containing the motor/actuator 154 and the polishing head 156, may be disposed on each of the polishing arms 150. The polishing head 156 is configured to hold the substrate 122 during polishing and while moving between CMP stations 130, 132. The motor/actuator 154 may be configured to press the substrate 122 while retained therein the polishing head 156 against the pad 184 disposed on the platen 186. The motor/actuator 154 may also rotate the substrate 122 about the center line if the polishing head 156.

In one embodiment, the hub 134, with pivotally attached polishing arms 150, is rotatable about its center axis. The polishing head assemblies 152 may be moved between the CMP stations 130, 132 and the transfer station 136 by indexing the hub 134 about its center axis. Additionally, each polishing arm 150 may pivot independently relative to other polishing arms 150 so each polishing head 156 may move independently. Polishing head 156 may move between adjacent locations in the polishing module 106. For example, the polishing head 156 may move between two adjacent polishing stations, two adjacent load cups, or adjacent load cup and polishing station depending on the rotational position of the hub.

Figure 2:
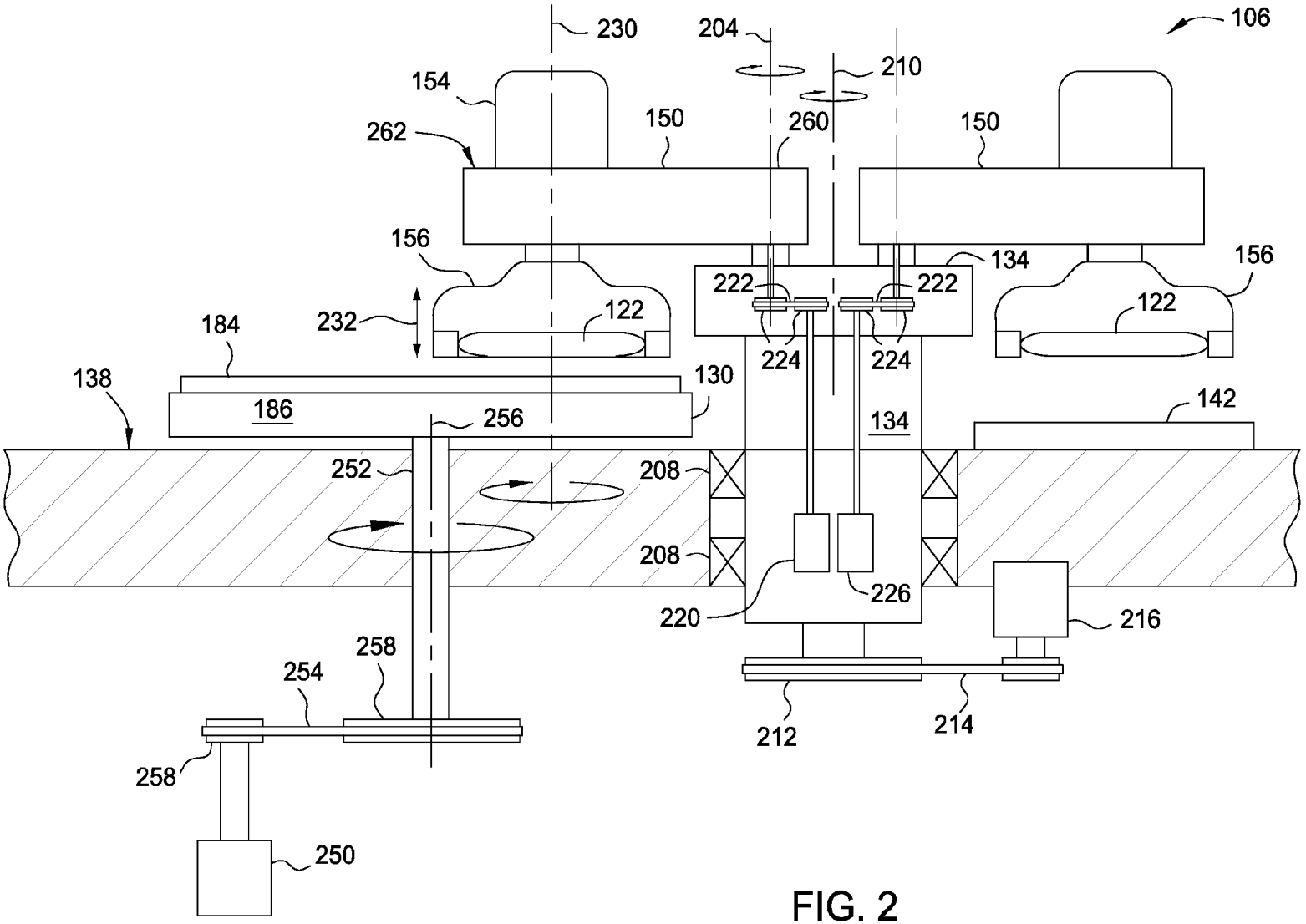
FIG. 2 is a partial cross sectional view for the polishing module of FIG. 1 taken along section lines 2-2, illustrating one embodiment of a substrate handler.

Referring now to FIG. 2, the CMP station 130 includes a motor 250 which may drive the rotation of the platen 186 about a platen centerline 256. The motor 250 may be connected to the platen 186 by gears, pulleys and belts, direct drive, or other suitable actuator. In one embodiment depicted in FIG. 2, the platen 186 is coupled to the motor 250 by pulleys 258 and belts 254. The motor 250 may control the rotational speed and direction of the platen 186. The CMP station 132 is similarly configured.

The hub 134 may have a central rotating mechanism that rotates the location of all pivotally attached polishing arms 150 and the attached polishing head assemblies 152 about a center axis 210 of the hub 134. The rotation of the hub 134 may additionally result in the specific polishing heads 156 moving from one processing station to another. The center axis 210 of the hub 134 may also be the centerline of the hub 134. A plurality of bearings 208 may stabilize the hub 134 while allowing the hub 134 to rotate. In one embodiment, the central rotating mechanism is a motor 216 which drives the rotation of the hub 134. The motor 216 may be connected to the hub by gears, pulleys and belts, direct drive, or other suitable means. In one embodiment depicted in FIG. 2, the hub 134 is coupled to the motor 216 by pulleys 212 and belts 214.

Each polishing arm 150 is pivotally attached at a first end 260 to the hub 134 so that the polishing arm 150 may rotate relative the center axis 210 of the hub 134 and additionally rotate relative to an arm pivot axis 204. In one embodiment, the arm pivot axis 204 of the polishing arm 150 is incongruent with the center axis 210 of the hub 134. The arm pivot axis 204 may be equally spaced about the center axis 210 of the hub 134 to provide minimal interference with adjacent polishing arms 150. For example, the pivot axis 204 for the polishing arms 150 may be arranged in a pattern, such as a bolt pattern, about the center axis 210 of the hub 134.

Motor 220 or other suitable device causes the polishing arm 150 to pivot about the arm pivot axis 204. The motor 220 may be connected to the hub by gears, pulleys and belts, direct drive, or other suitable actuator. In one embodiment depicted in FIG. 2, polishing arm 150 is coupled to the motor 220 by pulleys 222 and belts 224. As shown in FIG. 2, the motor 220 may be placed inside the hub 134. However, the motors 220, 226 for driving the rotation of the polishing arms 150 may also be disposed within the polishing arms 150 or at other suitable locations for controlling the rotation of the polishing arms 150.

The motor/actuator 154, disposed at a second end 262 of the polishing arm 150, controls the rotation and vertical displacement of the polishing head 156. The motor/actuator 154 may be connected to the polishing head 156 by a series of gears, idlers, belts and pulleys, a direct drive, or other suitable means. The motor/actuator 154 may rotate the polishing head 156, as well as the substrate 122 held by the polishing head 156, about a polishing centerline 230. Additionally, the motor/actuator 154 may move the polishing head 156 vertically up and down along the polishing centerline 230, as shown by arrow 232. Upon the polishing arm 150 rotating the polishing head 156 above the platen 186, the motor/actuator 154 may move the polishing head 156 downward to place the substrate 122 in contact with the pad 184 for polishing the substrate 122.

After polishing the substrate 122 on the pad 184, the motor/actuator 154 may move the polishing head 156 upward so as the substrate 122 is clear of the pad 184 and the substrate 122 may be moved to another platen or to the load cup 142. To appreciate the movement of the substrate 122 within the polishing module 106, we turn the discussion to FIG. 3.

Figure 3:
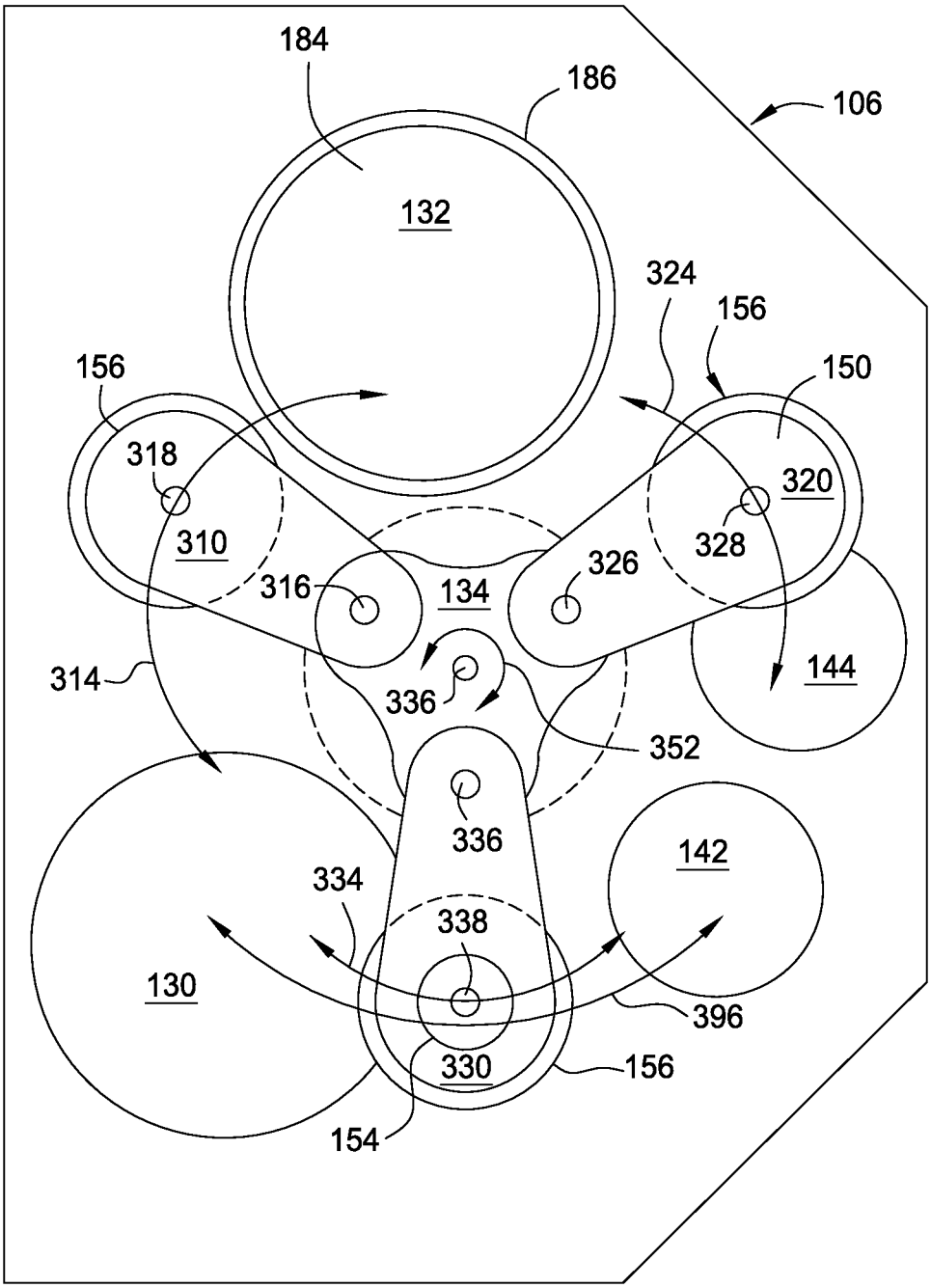
FIG. 3 is a top view of the polishing module of FIG. 2 having arms extending from a central hub.

FIG. 3 is a top view of the first embodiment for the hub 134 and attached polishing arms 150 shown in FIG. 2. The hub 134 of the polishing module 106 may rotate about the center axis 210 of the hub 134 which may be at the center of the hub 134, as shown by arrow 354. The hub 134 includes three polishing arms 150 which rotate about the arm pivot axis 204. In the embodiment depicted in FIG. 3, the three polishing arms 150 are shown as: a first polishing arm 310 which pivots about a pivot 316 and may rotate as shown by arrow 314; a second polishing arm 320 which pivots about a pivot 326 and may rotate as shown by arrow 324; and a third polishing arm 330 which pivots about a pivot 336 and may rotate as shown by arrow 334. The pivots 316, 326, 336 are arranged about the center axis 210 of the hub 134 and incongruent with the center axis 210. Therefore the polishing arms 150 may move about the pivots 316, 326, 336 and may additionally move about the center axis 210 by pivoting the hub. For example, the third polishing arm 330 additionally rotates about the center axis 210 as shown by arrow 396 by pivoting the hub 134.

Each polishing arm 150 supports a respective one of the polishing heads 156. Each polishing head 156 holds a substrate 122 (not visible in FIG. 3) for polishing in the polishing module 106. The polishing head 156 may hold the substrate 122 in one polishing station for processing, then move the substrate 122 to the next polishing station for further processing. Alternatively, the polishing head 156 may retain the substrate 122 in a single polishing station then return the processed substrate 122 to the load cup without subsequent processing at the other polishing stations of the polishing module 106. The time each substrate 122 spends at each polishing station may be different due to differences process requirements. To advance one substrate 122 upon completion of a first operation in the polishing module 106 prior to a second substrate finishing a second operation in the polishing module 106, the polishing arms 150 are configured to move independently of each other. Thus, the first substrate retained in one polishing head may advance to perform subsequent operations while a second substrate retained in a different polishing head is still being polished in a different polishing station of the polishing module 106.

Depending on where the hub 134 is indexed, the first polishing arm 310 may have access to one or more stations in the polishing module 106. For instance, without rotating the hub 134, the first polishing arm 310 may access the CMP station 132 by rotating clockwise about pivot 316. Additionally, the first polishing arm 310 may access CMP station 130 by rotating counter clockwise about pivot 316. Thus the substrate 122 held by the polishing head 156 supported by the first polishing arm 310 may have access to CMP station 130 and CMP station 132 without rotating the hub 134 or disturbing other substrates currently disposed in the polishing heads 156 of other polishing arms 320, 330.

The substrate 122 held by the polishing head 156 in the first polishing arm 310 may also be rotated between polishing stations 130, 132 by indexing the hub 134. In this manner the first polishing arm 310 may be advantageously positioned to move the substrate 122 between different stations or load cups of the polishing module 106. For example, the first polishing arm 310 may be positioned above the CMP station 130 and the substrate 122 may require a second polishing operation on the CMP station 132. During or upon completion of the polishing operation in the first polishing station 130, the hub 134 may index in a clockwise direction so the first polishing arm 310 can reach the load cup 144 upon completion of a polishing operation on CMP station 132 without having to further rotate the hub 134 or affecting the operation of the other polishing arms 150.

In another example, substrates 122 coming into the polishing module 106 may require but a single polishing operation by either the CMP station 130 or the CMP station 132. Instead of each substrate 122 indexing with the hub 134 and waiting for a subsequent substrate to be polished, the hub 134 may be stationary and the polishing arms 150 may move the substrate back and forth between the adjacent CMP stations 130, 132 and the load cups 142, 144. For instance, the hub 134 may be in a position wherein the second polishing arm 320, by rotation about the pivot 326, may access the load cup 144 and the CMP station 132. Additionally, the third polishing arm 330 may access the load cup 142 and the CMP station 130 by rotation about the pivot 326. Thus, a plurality of substrates may be loaded and processed on CMP station 130 and CMP station 132 independently of each other. Operating in this manner may effectively allow two different processes to be performed in different stations on a single polishing module 106.

The various processes performed at the CMP stations 130, 132 in the polishing module 106 may require more or less time than other processes performed at the CMP stations 130 132 in the polishing module 106. The operation of the polishing arms 150 pivotally attached to the hub 134 independent of each other provides optimization of the time required to process a substrate by not having to wait for the completion of processing other substrates. Additionally, the independence of each polishing arm 150 allows for the oscillation of the substrate 122 at the CMP station 130 while polishing without consideration of ongoing processes performed at the CMP station 132 in the polishing module 106.

Figure 6:
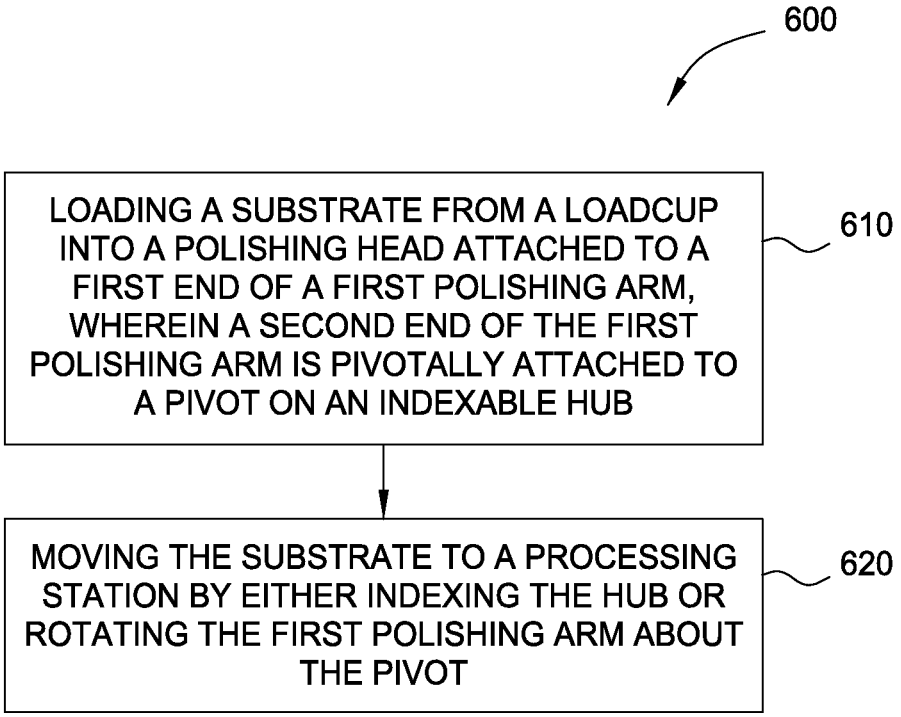
FIG. 6 is a flow diagram of a method for moving a substrate through a chemical mechanical polishing system.

An understanding for the various movements of the substrates 122 through the polishing module 106 may benefit by briefly referring to FIG. 6. FIG. 6 is a method for moving a substrate through a CMP system 100 shown in FIG. 2.

At step 610, a substrate is loaded from a load cup into a polishing head attached to a first end of a first polishing arm. A second end of the first polishing arm is pivotally attached to a pivot on an indexable hub. The pivot allows for the polishing arm to move independent of the indexable hub.

At step 620, the substrate is moved to a processing station by either indexing the hub or rotating the first polishing arm about the pivot. Indexing the hub moves all the polishing arms attached to the hub. Thus, without pivoting the polishing arms, the substrates loaded into polishing heads supported by the polishing arms move from one location to another in the same direction the hub indexes. However, rotating the polishing arm moves each substrate individually without moving other substrates.

Additionally, a second substrate may be loaded into a second polishing head attached to a first end of a second polishing arm. A second end of the second polishing arm may be pivotally attached to a second pivot on the indexable hub. The second substrate may be moved to the processing station by rotating the second polishing arm about the second pivot if the hub was previously indexed or indexing the hub if the first polishing arm was rotated. By pivoting the second polishing arm instead of indexing the indexable hub, the location of the first polishing arm is unchanged. By indexing the hub, the polishing arms are advantageously placed to access additional polishing stations or load cups. Is this manner, substrates may be processed and moved independent of each other.

Figure 4:
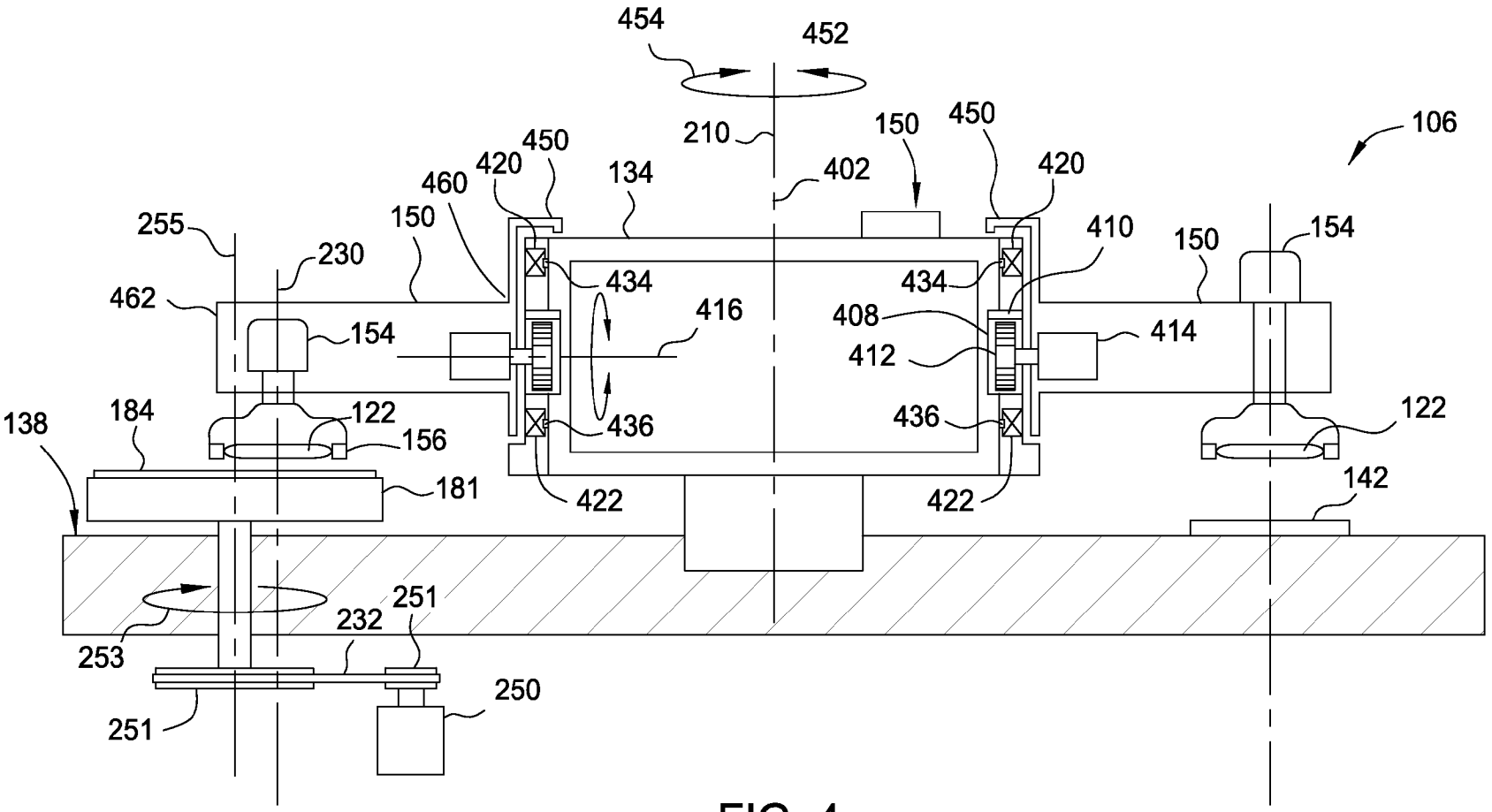
FIG. 4 depicts the partial cross sectional view of another embodiment of a substrate handler that may be used in the CMP system 100 of FIG. 1.

FIG. 4 depicts the partial cross sectional view of another embodiment of a substrate handler that may be used in the CMP system 100 of FIG. 1. Although any number of arms may be utilized as space permits, three arms are described to simplify the description. In the second embodiment of FIG. 4, the center axis 210, of the hub 134, and a center axis 402, about which the polishing arms 150 may rotate, may be congruent. In one embodiment, the hub 134 does not index. In another embodiment, the hub 134 may index via a manner similar to that previously described with the discussion of FIG. 2.

Figure 5:
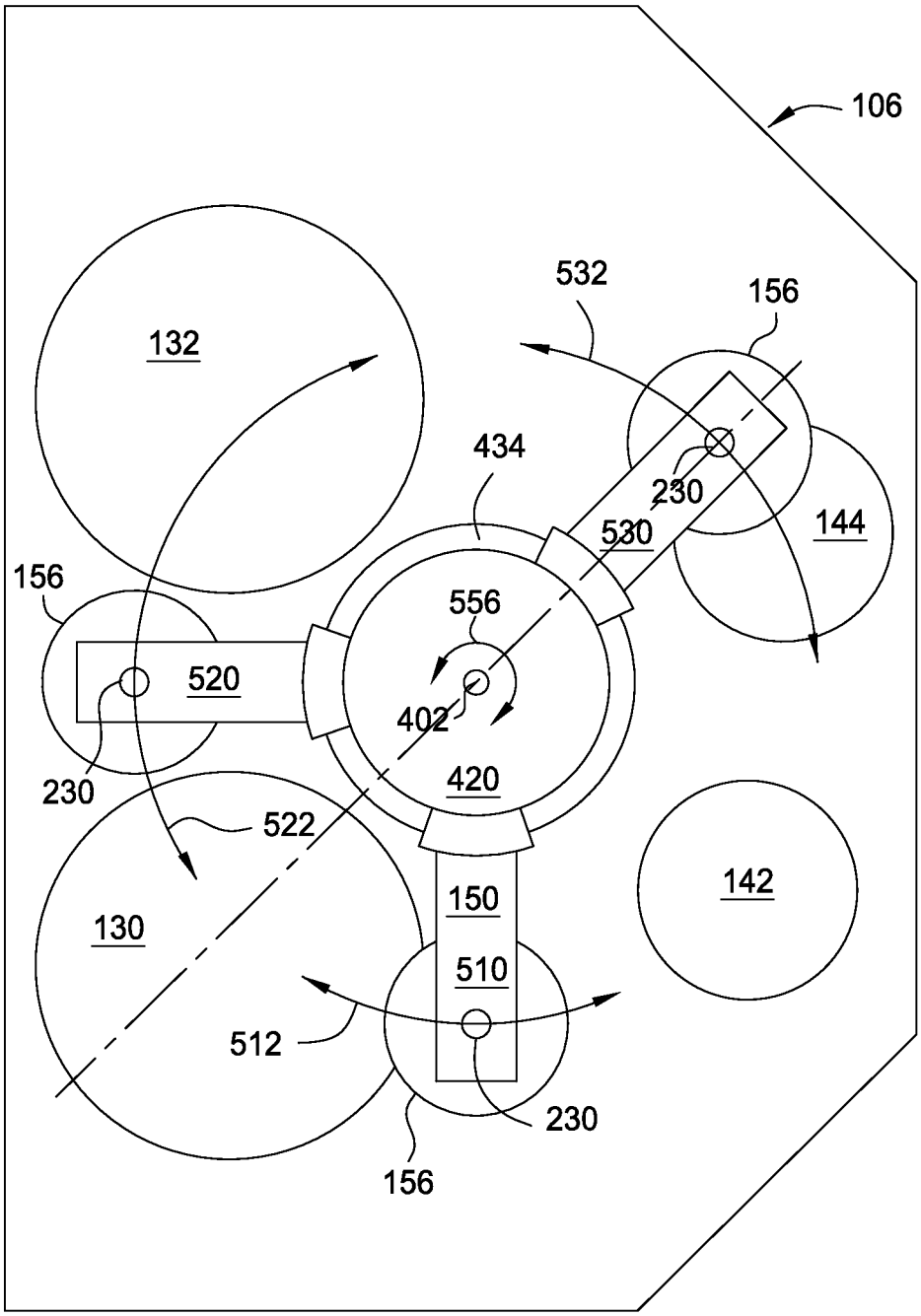
FIG. 5 is a top view of the polishing module of FIG. 4 having a central hub and attached arms.

The hub 134 has rails 434, 436 on which a first end 460 of the polishing arm 150 rides. The rails 434, 436 are circular and along the perimeter of the hub 134 (As shown in FIG. 5). The polishing arm 150 has a bottom bearing block 422 which rides on the rail 436 and a top bearing block 420 that rides on the rail 434 to allow the polishing arms 150 to freely move around the hub 134. Alternately, the hub 134 and polishing arms 150 may have other suitable connections therebetween, such as internal rails or circular members, which allow the polishing arms 150 to move independently about the center axis 402 congruent with the center axis 210 of the hub 134.

The polishing arm 150 may have a drive gear assembly 408, or other suitable actuator, for moving the polishing arm 150 about the perimeter of the hub 134. The drive gear assembly 408 may be disposed, wholly or in part, in the hub 134. The drive gear assembly 408 may include a motor 440, a pinion 412 and a rack 410. The motor 440 may be attached to the polishing arm 150 proximate the perimeter of the hub 134. The pinion 412 may be attached to the motor 440. The pinion 412 engages the rack 410 attached to the hub 134. The motor 440 rotates the pinion 412 which advances the polishing arm 150 along the rack 410 disposed along the perimeter of the hub 134. By controlling the rotational direction of the pinion 412, the angular direction in which the polishing arm 150 rotates about the center axis 402 may be selected. Advantageously, the drive gear assembly 408 is disposed inward of the platen and polishing pad. Therefore, substantially no contamination generated from the drive gear assembly 408 can fall upon the pad and affect substrate polishing operations.

In the embodiment illustrated in FIG. 4, the motor 414 is disposed in the polishing arm 150. In another embodiment, the motor 414 is disposed in the hub 134. In yet another embodiment, the motor 414 may be disposed below the upper side 138 of the machine base 140. It is contemplated that the motor 414 may be situated in any suitable location for interfacing with the drive gear assembly 408 and controlling the position of the polishing arm 150.

The position of the polishing arm 150 selectively aligns the polishing heads 156 with the CMP stations 132, 130 and/or the load cups 142, 144. After polishing the substrate 122 on the pad 184 in one CMP station, the substrate 122 may be moved to another CMP station or to one of the load cups. How the substrate 122 may be moved within the polishing module 106 is discussed below with reference to FIG. 5.

FIG. 5 is a top view of the second embodiment of the hub 134 and attached polishing arms 150 in the polishing module 106 shown in FIG. 4. In one embodiment, the hub 134 of the polishing module 106 may rotate about the center axis 402 as shown by arrow 556. In another embodiment, the hub 134 may be stationary with only the polishing arms 150 rotating about the center axis 402.

In the embodiment depicted in FIG. 5, the hub 134 includes three polishing arms 150 all of which may rotate about the same center axis 402. The polishing arms 150 are illustrated in FIG. 5 as: a first polishing arm 510 which pivots about the center axis 402 as shown by arrow 512; a second polishing arm 520 which pivots about the center axis 402 as shown by arrow 522; and a third polishing arm 530 which pivots about the center axis 402 as shown by arrow 532.

Each polishing arm 150 supports a respective polishing head 156 which hold the substrate 122 (not visible in FIG. 5) for polishing by the polishing module 106. The polishing module 106 has a variety of stations including two CMP stations 130, 132 and two load cups 142, 144. The substrate 122 may be processed in one or more of the polishing stations prior to being returned to the load cup for removal from the polishing module 106. The polishing arms 150 may move independently of each other in order to advance the substrates 122 upon completion of a respective polishing operation without causing other substrates to move. Thus, the substrates may advance prior to and independently of processing for other substrates.

The polishing head 156 is rotatable about a polishing centerline 230 located at the end of the polishing arm 150 opposite the hub 134. The first polishing arm 510 may rotate along the entire perimeter of the hub 134. The rotation of the first polishing arm 510 may align the polishing head 156 selectively to one of the stations in the polishing module 106. For instance, the first polishing arm 510 may access the CMP station 132 by rotating clockwise about the center axis 402. Additionally, the first polishing arm 510 may access the load cup 142 by rotating counter clockwise about the center axis 402. Thus the substrate 122 held by the polishing head 156 may have access to CMP station 130 and load cup 142 without rotating the hub 134 or disturbing other substrates 122 currently held by the other polishing arms 150.

In another example, the substrates 122 coming into the polishing module 106 may require only a single polishing operation by either the CMP station 130 or the CMP station 132. Instead of each substrate 122 indexing one at a time with the hub 134 and waiting for a subsequent substrate to be polished, the polishing arms 150 may move about the stationary hub 134 and thus move the substrate back and forth from the CMP station 130, 132 to the load cups 142, 144. For instance, the first polishing arm 510 may independently access the load cup 142 and the CMP station 130. Additionally, the third polishing arm 530 may independently access the load cup 144 and the CMP station 132. Thus, a plurality of substrates may be loaded and processed on CMP station 130 and CMP station 132 independently and without interfering with the operation of each other.

Thus, the present invention represents a significant advancement in the field of semiconductor substrate cleaning and polishing. The substrate handler is adapted to support and transfer substrates in a manner which allows the substrates to be processed independently of each other. Thus, the handler is more versatile and more easily adaptable to various substrate processing sequences. Additionally, the placement of the drive mechanisms for the polishing arms facilitate the movement of the substrates without introducing contamination from the substrate handler which may affect substrate polishing operations.

While the foregoing is directed to embodiments of the present invention, other and further embodiments of the invention may be devised without departing from the basic scope thereof, and the scope thereof is determined by the claims that follow.

The invention claimed is:

1. A chemical mechanical polishing system, comprising:
a platen;
a load cup;
a hub;
a first polishing arm cantilevered from the hub and rotatable around a centerline of the hub between the platen and the load cup; and
a second polishing arm cantilevered from the hub and rotatable around the centerline of the hub between the platen and the load cup, wherein the second polishing arm and first polishing arm rotate independently from a rotation of the hub.

2. The system of claim 1 further comprises:
a polishing head attached to the first polishing arm, wherein the polishing head is configured to hold a substrate and place the substrate against the platen during processing.

3. A chemical mechanical polishing system, comprising:
a platen;
a load cup;
a hub rotatable about a first axis;
a first polishing arm pivotally attached to a first pivot on the hub and moveable between the platen and load cup; and
a second polishing arm pivotally attached to a second pivot on the hub and moveable between the platen and load cup.

4. The system of claim 3 further comprises:
a first motor disposed in the hub for rotating the first polishing arm; and
a second motor disposed in the hub for rotating the second polishing arm.

5. The system of claim 3 further comprises:
a drive gear assembly disposed in the hub; and
a motor engaging the drive gear assembly and operable to rotate the first polishing arm independently of the second polishing arm.

6. The system of claim 3 further comprises:
a polishing head attached to the first polishing arm, wherein the polishing head is configured to hold a substrate and place the substrate against the platen during processing.

7. The system of claim 6 further comprises:
a second load cup; and
a second platen.

8. The system of claim 7 wherein the first polishing arm and the second polishing arm are rotatable between the second load cup and the second platen.

9. The system of claim 8 wherein the second polishing arm is configured to move a second polishing head between the load cup and the platen without moving the polishing head of the first polishing arm.

10. The system of claim 7 wherein a centerline of the first pivot of the first polishing arm is incongruent with the centerline of the hub.

11. A method for moving a substrate by a substrate handler, the method comprising:
loading a substrate from a load cup into a first polishing head attached to a first end of a first polishing arm, wherein a second end of the first polishing arm is pivotally attached to a first pivot on an indexable hub; and moving the substrate to a processing station by either indexing the hub or rotating the first polishing arm about the first pivot.

12. The method of claim 11 further comprising:

loading a second substrate from the load cup into a second polishing head attached to the first end of a second polishing arm, wherein a second end of the second polishing arm is pivotally attached to a second pivot on the indexable hub; and moving the second substrate to the processing station by rotating the second polishing arm about the second pivot if the hub was previously indexed or indexing the hub if the first polishing arm was rotated.

13. The method of claim 12 wherein moving the second substrate by pivoting the second polishing arm does not move the substrate in the first polishing arm.

14. The method of claim 11 wherein the first and second polishing head are configured to access at least one load cup and at least one platen.

15. The method of claim 14 wherein a first and second motion assembly configured to pivot the first and second polishing arms, are disposed inward of the load cup and platen.

16. The method of claim 12 wherein a centerline for the first and second pivots of the first and second polishing arms are incongruent with a centerline of the indexable hub.

17. A chemical mechanical polishing system, comprising:

a platen;

a load cup;

a hub;

a first polishing arm cantilevered from the hub and rotatable around a centerline of the hub between the platen and the load cup;

a second polishing arm cantilevered from the hub and rotatable around the centerline of the hub between the platen and the load cup, the second polishing arm rotatable independently from the hub;

a first motor disposed in the hub for rotating the first polishing arm; and a second motor disposed in the hub for rotating the second polishing arm.

18. A chemical mechanical polishing system, comprising:

a platen;

a load cup;

a hub;

a first polishing arm cantilevered from the hub and rotatable around a centerline of the hub between the platen and the load cup;

a second polishing arm cantilevered from the hub and rotatable around the centerline of the hub between the platen and the load cup, the second polishing arm rotatable independently from the hub;

a drive gear assembly disposed in the hub; and a motor engaging the drive gear assembly and operable to rotate the first polishing arm independently of the second polishing arm.

19. A chemical mechanical polishing system, comprising:

a platen;

a load cup;

a hub;

a first polishing arm cantilevered from the hub and rotatable around a centerline of the hub between the platen and the load cup;

a second polishing arm cantilevered from the hub and rotatable around the centerline of the hub between the platen and the load cup, the second polishing arm rotatable independently from the hub;

a second load cup; and a second platen.

20. The system of claim 19 wherein the first polishing arm and the second polishing arm are rotatable between the second load cup and the second platen.

* * * * *